United States Patent [19]

Beltz et al.

[11] Patent Number: 4,498,451

[45] Date of Patent: Feb. 12, 1985

[54] CUTTING ARTICLES ALONG KNOWN PLANES

[75] Inventors: Richard K. Beltz, Hamburg; Donald M. Large, Temple, both of Pa.

[73] Assignee: AT&T Technologies, Inc., New York, N.Y.

[21] Appl. No.: 520,662

[22] Filed: Aug. 5, 1983

[51] Int. Cl.[3] ..... B28D 1/32

[52] U.S. Cl. ..... 125/23 R; 225/103

[58] Field of Search ..... 225/103; 125/23 R, 23 C, 125/23 T, 13 R

[56] References Cited

U.S. PATENT DOCUMENTS

| | | | |
|---|---|---|---|
| 459,773 | 9/1891 | Van Arsdale | 125/23 R |
| 1,275,459 | 8/1918 | Miller | 125/23 R |
| 4,343,287 | 8/1982 | Hallberg | 125/23 R |

FOREIGN PATENT DOCUMENTS

| | | | |
|---|---|---|---|
| 436473 | 3/1912 | France | 125/23 R |

*Primary Examiner*—Harold D. Whitehead
*Attorney, Agent, or Firm*—D. C. Watson

[57] ABSTRACT

An article such as a semiconductor wafer (10) is cut by splitting along a line (22) in a plane known to facilitate splitting. Wafer (10) is supported in a laterally unrestrained manner in a holder (34) lined with preferred paper (26) and fitted with a reference plate (43). Paper liner (26) is of a type having a surface (25) capable of developing lateral restraint by friction between such surface (25) and a surface (13) of wafer (10). A resilient force is applied normal to and upon a top surface (11) of wafer (10) by a press (60) having members (75 and 76) applied along line (22). Separation stresses develop along line (22) of the splitting plane and friction forces develop along paper surface (25) providing lateral resistance to an expected cutting force. A cutter (80) has an elongate tool (92) which is advanced at a top edge (27) of wafer (10) where it abuts plate (43). Tool (92) has a leading edge (94) for cutting and lateral faces (95 and 96) converging angularly toward edge (94) for separating cut surfaces. Tool (92) is advanced into and along the splitting plane at a preferred angle of about forty-five degrees between wafer surface (11) and elongate portion (93) of tool (92). Utilizing a micrometer assisted assembly (86), a gradual, calibrated force is applied to advance tool (92) for a precise distance into wafer (10). Tool (92) provides sufficient cutting and separation that a split becomes self-propagating along line (22) through wafer (10).

12 Claims, 4 Drawing Figures

CUTTING ARTICLES ALONG KNOWN PLANES

TECHNICAL FIELD

This invention relates to cutting articles along planes therein known to facilitate splitting. More particularly, the invention relates to cutting portions from monocrystalline wafers by splitting through known planes such as cleavage planes.

BACKGROUND OF THE INVENTION

An article may be cut by many methods, each selected according to known criteria including an expected use of the cut article. For example, in the gem stone industry, chunks of natural crystals are cut by splitting off portions along planes of known weakness, usually cleavage planes. The cut surfaces (called facets) along such planes are generally mirror-like and smooth with special optical properties. Light incident to the facets is predominantly reflected in a brilliant display and usually very little light passes through the facets and into the crystal.

Generally, in the semiconductor industry, crystals similar to natural crystals have been grown in a bulk, monocrystalline manner and formed into substantially planar wafers for device manufacture. The devices were cut from a wafer by rough methods such as by scribing and breaking or by sawing, probably because the cut surfaces were of little concern in operation of the devices. Such concern is considerably different in the operation of laser chips.

Laser chips often have a bulk crystalline substrate and four layers of different composition grown thereupon by epitaxial methods in an arrangement called a heterostructure. The exposed, fourth layer and the substrate facilitate ohmic contact and the substrate also provides physical strength for the chip. The first and third layers inject electrons and holes, respectively, into the second, active layer under a properly biased condition. Within the active layer electrons and holes spontaneously combine and emit photons of light. When a photon impinges upon an uncombined electron, another photon is emitted (by stimulation) having the same frequency, direction and phase as the impinging photon. Amplificaton of light results by such stimulation, forming laser light which is desirably intense and coherent. The problem is to confine the light generation process in such a manner that a desired laser beam may be obtained from the chip.

Typically, the active layer is delineated by proton bombardment to form a channel region in the chip wherein light is directed toward two opposing ends transverse to known crystalline planes. The object is to have the spontaneously emitted light be predominantely reflected by crystal facet portions (called windows) at each side of the chip where the channel region is exposed. The reflected light then stimulates free electrons to emit coherent light and a laser beam is developed which penetrates the mirror-like windows in a manner suitable for light transmission. A problem is to properly divide the chips from a wafer, but such problem is greatly alleviated by thinning the substrate portion and breaking along the desired crystalline planes. A prior problem is to cut portions from a heterostructural wafer for inspection before the chips are divided, when the substrate is still thick.

Heretofore, such cutting was performed by operator-dependent, manual methods. A typical wafer has a rectangular outline about $\frac{3}{4}$ inch wide by about 1 inch long, the short sides being cut along a desired crystalline plane. Such cut wafer was placed upon a yielding surface and held in place with a cotton swab. Then a very sharp scriber in an almost vertical position was utilized to make short cutting strokes perpendicular and adjacent to a long side and ostensibly along the desired splitting plane. The strokes were repeated until splitting was initiated and a cut was self-propagated, hopefully along the desired plane and through the wafer. The above method was time consuming and fraught with waste caused by errant splits and scratches. Other methods utilizing conventional tools and impact forces were also too uncontrolled and low yielding to be acceptable.

Accordingly, it was desirable to develop new and improved expedients for cutting articles along planes known to facilitate splitting. Such splitting should be initiated by contact with as little of the cut surface as practical to avoid damage to such surfaces. Thereafter, the split should self-propagate along a desired plane through the article. The expedients should be particularly applicable to such synthetic crystalline articles as semiconductor wafers including those wafers having a heterostructural arrangement. It is desirable that narrow, elongate portions be cut from such wafers for inspection after heterostructural formation and before removal of unwanted substrate thickness. Moreover, the cutting should be done in a controlled, repetitive manner with a high yield of undamaged cut portions and residue portions.

SUMMARY OF THE INVENTION

Expedients are provided for cutting an article having at least one plane known to facilitate splitting therealong. The article is supported in a laterally unrestrained manner on a surface such as that provided by somewhat coarse paper on a smooth, hard support. Such surface is typically capable of developing lateral restraint for the article by force applied normal to and upon an exposed top surface of such article. Accordingly, a resilient force is applied normal to and upon the exposed top surface of the article along the splitting plane. Such force is sufficient to cause stress along such plane and to develop lateral resistance to an expected cutting force. A cutter is advanced at an exposed top edge of the article into and along the splitting plane at a given angle of from about 30 to about 60 degrees to the exposed top surface. The cutter advances for a distance sufficient to reach a region of stress developed in the splitting plane. Preferably, the cutter has wedge shaped faces to separate resulting cut surfaces sufficiently that a split develops and propagates through the article and along the splitting plane.

BRIEF DESCRIPTION OF THE DRAWING

The invention will be more readily understood from the following detailed description when read in conjunction with the accompanying drawing wherein.

Figure 1:
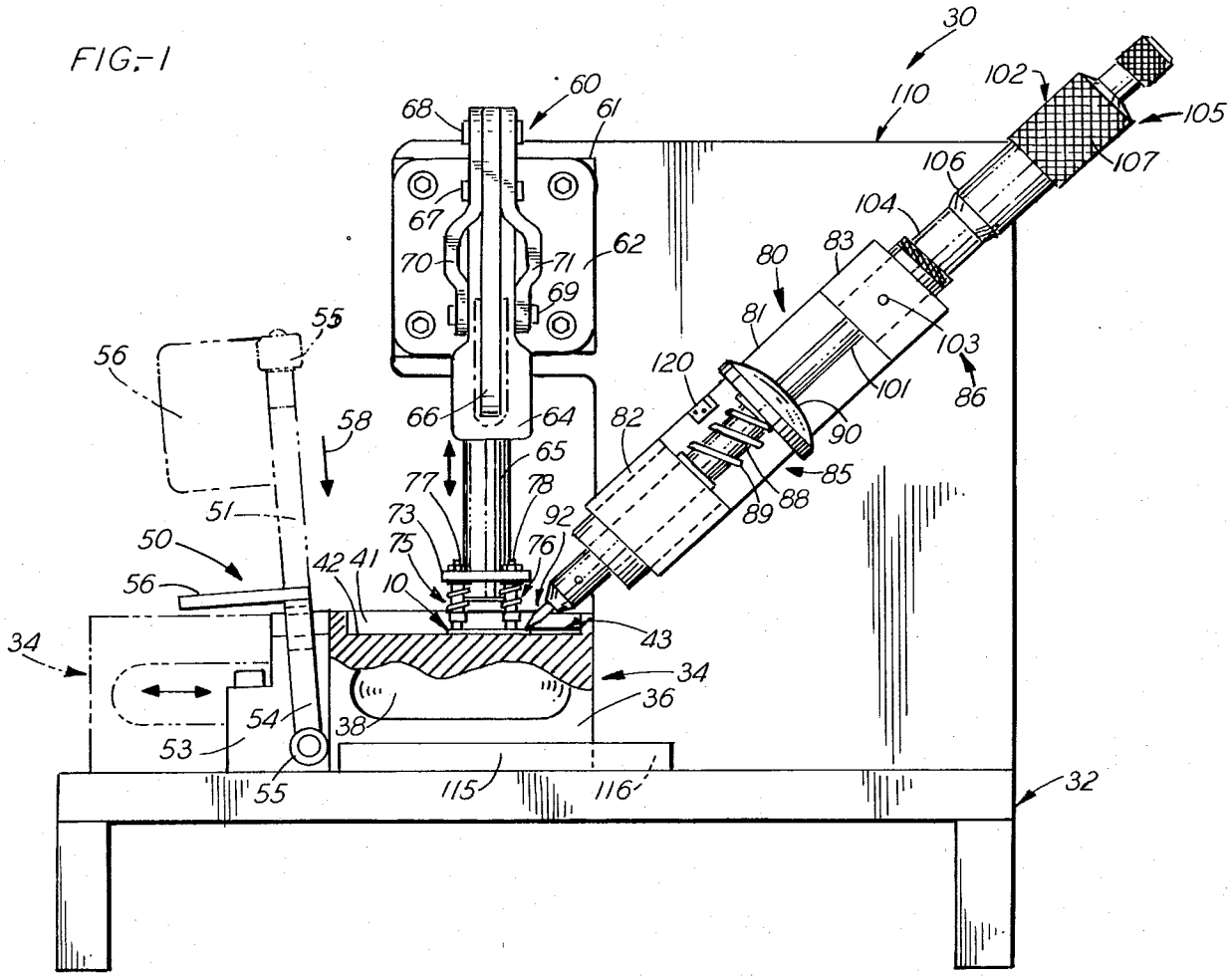
FIG. 1 is a front view of apparatus for cutting articles in accordance with the present invention.

It can be seen that some elements in the figures are abbreviated or simplified to highlight certain features of the invention. Also, where appropriate, reference numerals have been repeated in the figures to designate the same or corresponding features in the drawing.

DETAILED DESCRIPTION

The Articles

FIGS. 1–4 show an article 10 (also referred to as a wafer 10) which may be cut along known planes within the article in the practice of the instant invention. Such an article will be described herein primarily with respect to semiconductor wafers found in the electronics industry. Such wafers are typically formed of a synthetic monocrystalline material having many properties similar to those of natural crystals.

For example, many such articles are advantageously cut by splitting, i.e., by forcing and/or breaking portions apart along a grain, seam or layer. In crystals, such splitting occurs along planes of weakness known in the mineralogy art as cleavage, parting and fracture planes.

For the purpose of dividing an article, splitting is often preferred over other forms of cutting because the cut surfaces are essentially undisturbed. A cut is made at an edge of an article where a desired plane can be entered, preferably with a tool. Subsequent to or simultaneously with the cut, the severed surfaces are separated to initiate a split which then self-propagates along the desired plane through the article.

Such splitting may be done on many articles other than crystals providing brittleness and an otherwise predictable structure are present. For example, it is well known that fibrous, cellular materials such as some hardwood articles are amenable to splitting. When it is said that splitting takes place along a known plane, it is meant that resulting cut surfaces lie substantially in and along a predictable plane.

Figure 2:
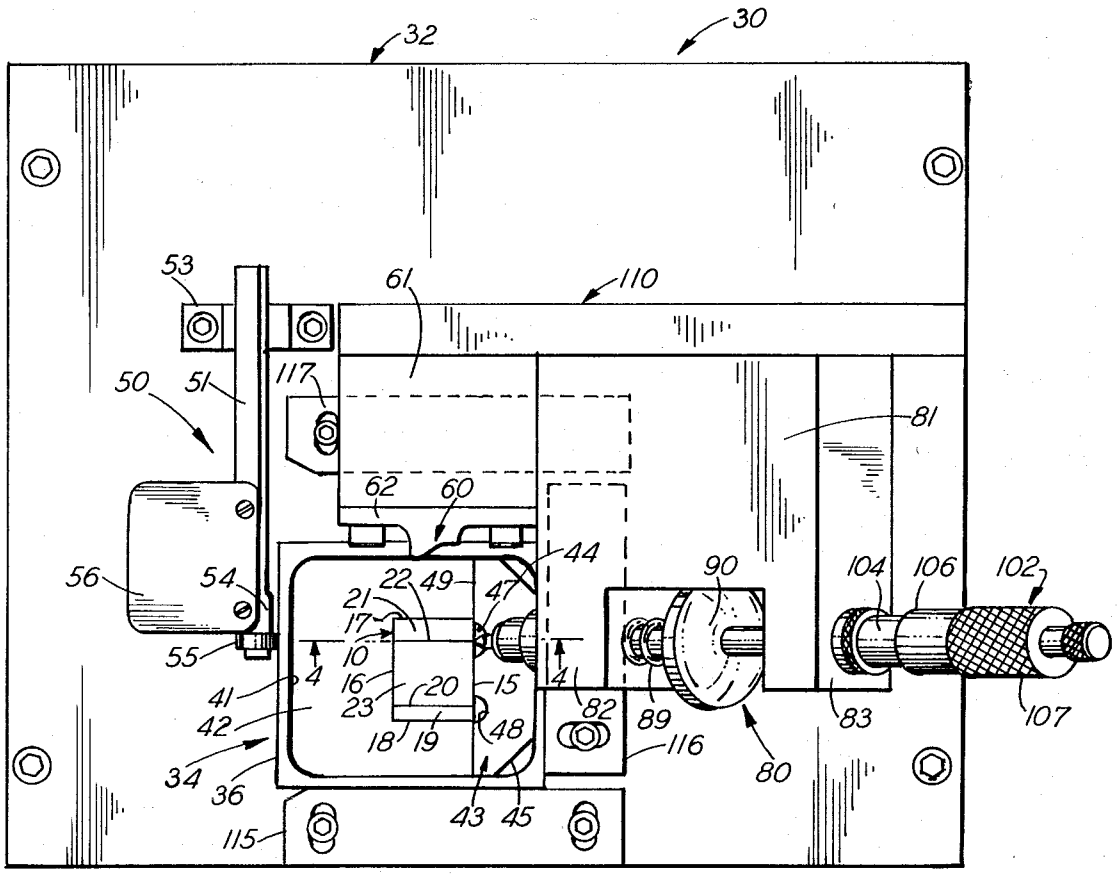
FIG. 2 is a plan view of the apparatus shown in FIG. 1.
Figure 4:
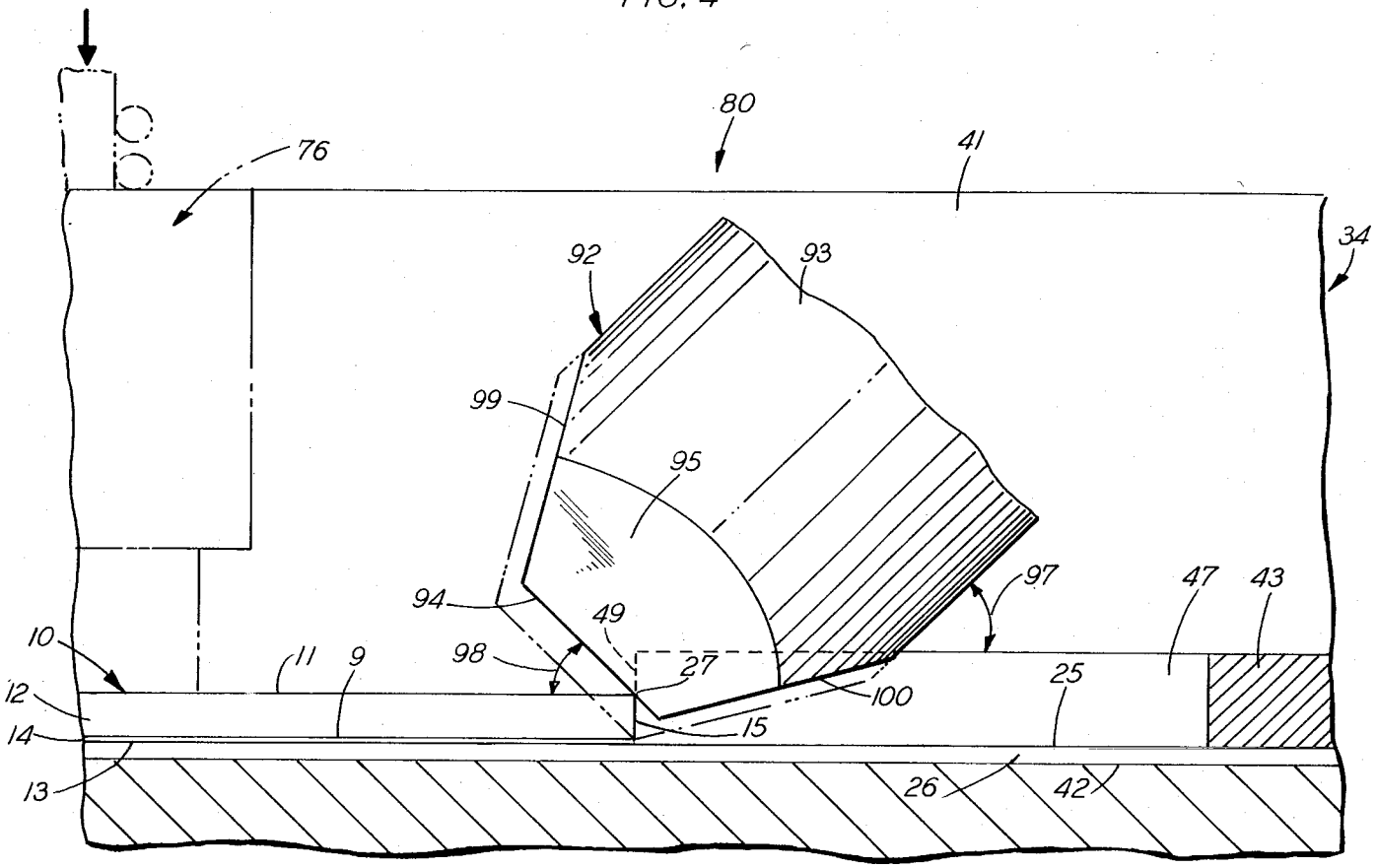
FIG. 4 is a partial, cross-sectional view taken along line 4—4 in FIG. 2 and enlarged to show the cutting process.

Cutting an article by splitting along known planes is especially convenient in forming laser devices from the semiconductor wafer 10 best seen in FIGS. 2 and 4. Wafer 10 may include a slice 12 (FIG. 4) of n-GaAs monocrystal which functions and is also referred to as a substrate 12. Substrate 12 is formed into a substantially flat condition according to crystal plane orientation. A major, top surface 11 is exposed and, substantially parallel thereto, another major surface 9 is covered as will be explained. Such surfaces are formed so a series of desired crystalline planes for splitting extend transversely of surfaces 11 and 9 and such planes are parallel to each other. In FIGS. 2 and 4, the splitting planes extend from left to right with respect to a viewer.

For processing purposes, wafer 10 is disposed in an inverted manner to that shown in FIG. 4 whereby surface 9 is turned upward. Surface 9 typically receives four epitaxial layers of differing function and composition grown in the following order: an electron donor region such as an n-AlGaAs layer, a light producing region such as a p-AlGaAs active layer, a hole donor region such as a p-AlGaAs layer and a positive contact p-GaAs layer. All four layers are hereafter referred to collectively as a heterostructure 14 having an outer major surface 13 as shown in FIG. 4.

The wafer 10 is analyzed to determine the condition and thickness of the substrate 12 and of each epitaxial layer. For example, a typical thickness of substrate 12 is about 0.016 inch and the layers are about 2 micron, 0.15 micron, 1.2 micron and 1 micron in thickness given in the order of their growth. The exact thickness of each layer and its condition bear importantly upon operation of laser chips made from wafer 10.

An electron microscope is utilized to perform the analysis of such microminiature features. Typically, a portion referred to as a shelf piece is cut from a wafer 10, the cut surface of the piece is scanned and a microphotograph is taken so precise measurements can be made. A problem is that epitaxial layers do not always grow uniformly over the full area of a substrate 12 such as over the full extent of surface 9 shown in FIG. 4. Therefore, inspection is performed at more than one location on the wafer 10.

As best seen in FIG. 2, wafer 10 is about 1 inch long measured along a reference side 15 and an opposite side 16 and about 0.75 inch wide measured along short sides 17 or 18. To get a fully representative inspection of wafer 10, a narrow (about 0.12 inch wide) shelf piece 19 is cut along a line 20, parallel to short side 18, and a wider (about 0.20 inch wide) shelf piece 21 is cut along a line 22, parallel to short side 17, leaving a residue portion 23. One can appreciate the slenderness of such pieces and the precarious nature of the crystal splitting. In the prior art, it was not unusual for a split to be initiated at reference side 15 and become self-propagating along a split plane designated by the line 20 in FIG. 2, only to have the split veer away and exit at side 18. It is theorized that such errant behavior occurs when a split develops partially through an article along one splitting plane and partially along at least one other adjacent plane.

One of the reasons errant splitting may occur is because wafer 10 has a composite arrangement including substrate 12 and heterostructure 14, each having different compositions. Another reason may be due to a somewhat amorphous internal condition of wafer 10 which occurs occasionally along its outer edges. Cutting such edge material to initiate splitting is a challenging task.

One solution to splitting an article along planes of weakness lies in reducing the overall thickness so the article may be broken along a straight edge without cutting with a tool. Such solution is now utilized to separate laser chips from a more fully developed wafer 10. However, the wafer 10 may not be reduced in thickness at the stage of development where inspection of layers is required. Consequently, splitting off portions such as shelf pieces 19 and 20 for inspection by cutting and splitting is required to avoid adding substantial cost to a relatively inexpensive wafer 10 which may be defective.

While the above discussion has dwelled primarily upon wafer 10 as an article to be split along known cleavage planes, it is to be understood that the invention is not so limited. The article 10 need not be a flat article providing it may be supported in an unrestrained manner and any required restraint may be developed by a resilient force applied normal to and upon the article. Also, the article need not be a composite wafer, a semiconductor wafer or even a synthetic or natural crystal providing the article has predictable planes known to facilitate splitting.

Cutting the Articles

Figure 3:
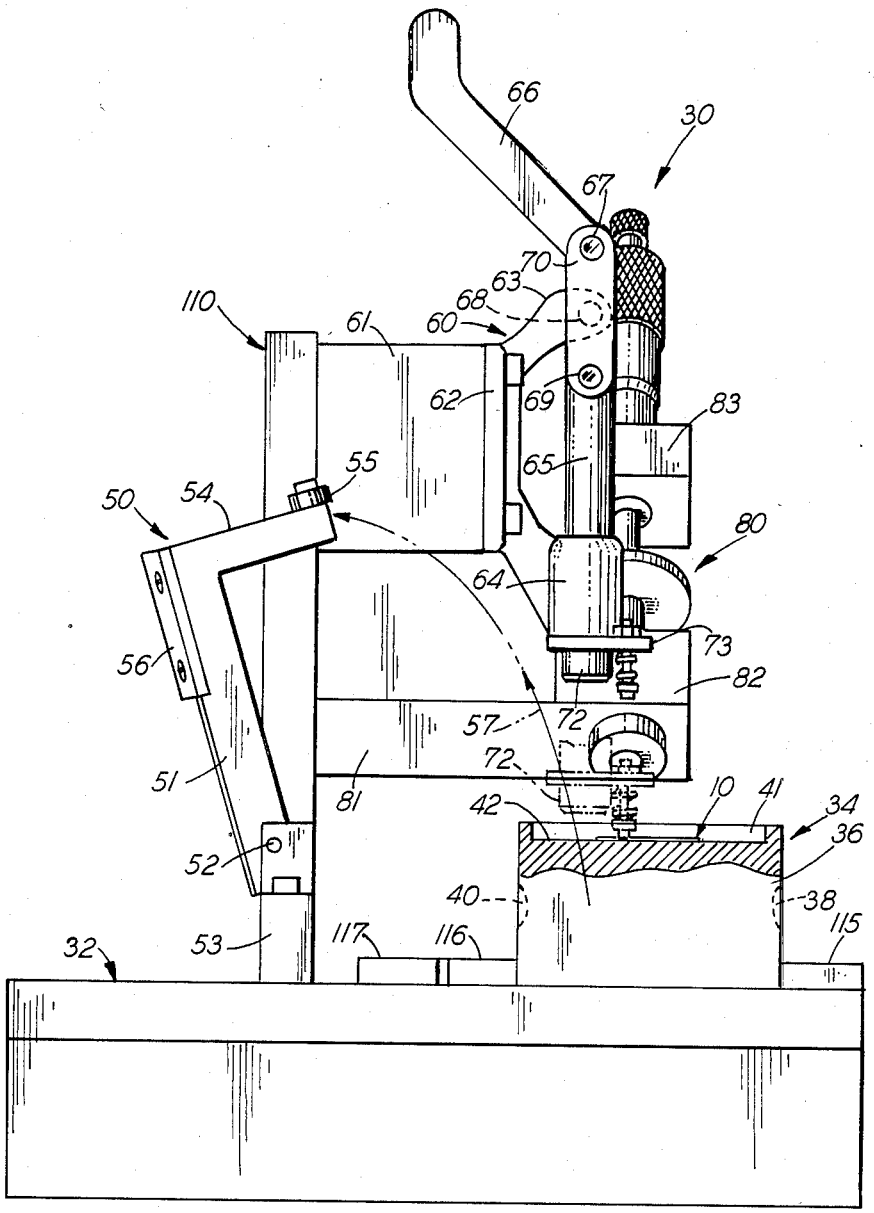
FIG. 3 is a side view of the apparatus shown in FIG. 1.

Apparatus for cutting articles by splitting the same along known planes is shown in FIGS. 1–3, designated generally by the numeral 30. Such apparatus includes generally designated items such as a platform 32, a wafer holder 34, a holder positioner 50, a wafer press 60, a cutter 80, a support stand 110 and miscellaneous accessories. The platform 32 supports stand 110 which further supports wafer press 60 by way of a block 61 and cutter 80 by way of a bifurcated block 81 having arms 82 and 83. Platform 32 also supports the holder positioner 50, the wafer holder 34 and holder positioning plates 115, 116 and 117 which are adjustable laterally on platform 32.

Wafer holder 34 is made of a material such as stainless steel in the form of a block 36 about 2.5 inches square and about 1.5 inches high. Dished slots 38 and 40 (FIG. 3) are cut into opposing sides of block 36 for accommodating one's fingers in grasping holder 34. Also, a recess 41 having a floor 42 is cut into the top surface of block 36 to accommodate a wafer 10 and a wafer locating plate 43.

As best seen in FIG. 2, the locating plate 43 fits within the recess 41 of holder 34 in a precise manner. Plate 43 is preferably made from a readily machined, preferably stainless steel, plate which is thicker than the wafer 10 to be located. Relief cuts 44 and 45 are made in plate 43 at two corners to avoid an interference fit with respective corners of recess 41.

The function of plate 43 is to align reference side 15 of a wafer 10 so such reference side is precisely perpendicular to cutter 80 when a cut is made. Accordingly, plate 43 is carefully machined to exactly fit into recess 41 to achieve the locating function. Also, cutter clearance notches 47 and 48 are provided along a carefully machined, reference side 49 of plate 43 to enable a tool to properly address a wafer 10 in a manner to be explained later.

In placing the wafer holder 34 in proper position on platform 32, it is advisable to urge block 36 against plate 116 and holder positioner 50 is provided for that purpose. As best seen in FIG. 3, positioner 50 includes an arm 51 which swings upwardly about a pivot pin 52 set in a base 53. Arm 51 has a depending portion 54 to which is attached a roller 55 and on top of arm 51 a thumb rest 56 is provided to grasp and manipulate positioner 50. The pivoting action of positioner 50 is seen by arrow 57 in FIG. 3 wherein arm 51 is shown in a raised position and by arrow 58 in FIG. 1 wherein arm 51 is lowered. It can be seen in FIG. 2 that arm portion 54 with the roller 55 is brought downwardly and toward holder 34 so block 36 is contacted and holder 34 is cammed toward plate 116.

In the practice of the invention, an article such as a wafer 10 is supported on its major side 13 (FIG. 4) in an initially, laterally unrestrained manner. By this it is meant that no restraints, for example mechanical clamps, are applied such as along the sides 15–18 (FIG. 2) of wafer 10.

Advantageously, wafer 10 is supported on a friction-developing surface such as a surface 25 of a paper liner 26 for recess 41 as shown in FIG. 4. Paper liner 26 is applied to a smooth, hard support such as that provided by the floor 42 of recess 41 which should be finished as flat as practicable. Preferably, paper liner 26 has a somewhat coarse finish such as that provided by laboratory filter paper. A suitable paper is made by Whatman Ltd. in England and sold as hardened #50 filter paper.

Such paper is typical of a material which provides a surface 25 capable of developing lateral restraint for a wafer 10. For example, the paper 26 and the wafer 10 are mounted as shown in FIG. 4. Then a force is applied normal to and upon exposed top surface 11 which causes friction to develop between surface 25 of the paper and surface 13 of the wafer. Such friction develops lateral resistance to an expected cutting force.

The force applied to develop lateral resistance to movement of wafer 10 is further utilized in the practice of the invention to develop separation stresses along a desired plane in wafer 10. A problem is to apply a controlled force so the friction and the separation stresses develop uniformly over surface 13 and along a splitting plane, respectively. Wafer press 60 is provided to solve this problem.

Wafer press 60 is shown in front view in FIG. 1; it is cut away to show wafer 10 in FIG. 2; and it is shown in side view in FIG. 3. Press 60 includes a bifurcated bracket 62 (FIG. 3) affixed to block 61 and bracket 62 has an upper arm 63 and a lower arm containing a linear bearing 64. Bearing 64 guides a vertically slidable rod 65 which moves in response to arcuate motion of a toggle arm 66. Arm 66 has a sloping "Z" configuration wherein a free leg is covered with a plastic cap. The other leg is pivotally attached to an upper pin 67 and a middle pin 68 (FIG. 3). Rod 65 is pivotally connected by a pin 69 to a pair of links 70 and 71 (FIG. 1) which straddle arm 63 and pin 68 in the elevated position shown in FIG. 3 and are pivotally connected at their upper ends to pin 67. The items 62–71 are assembled and sold by Dover Corporation of Detroit, Mich. as its Model 603, straight-line action toggle clamp.

In FIG. 3, rod 65 is shown elevated by about 1.25 inches from its active position shown in phantom lines. Such elevation of rod 65 is accomplished by moving arm 66 arcuately upward from the active position shown in FIG. 1 to the inactive position shown in FIG. 3.

A cylindrical head screw 72 (FIG. 3) is threaded axially upward into the lower end of rod 65 to connect a plate 73 which is thereby disposed nearly horizontally. At the outer portion of plate 73, two depending, resiliently operating, pressure members are provided, designated generally by the numerals 75 and 76 (FIG. 1).

Each of members 75 and 76 include a special stud 77 and 78, respectively, slipped through a compression spring and affixed upwardly by a nut to plate 73. Each special stud 77 and 78 also has a bore provided in its downwardly depending head. A cylindrical pad is inserted into the bore and each pad is made of a resiliently compressible material such as neoprene.

In cutting an article 10, a cutter 80 is advanced at an exposed top edge of side 15 of wafer 10 into and along a splitting plane such as that depicted by line 22 shown in FIG. 2. The construction of cutter 80 is best seen by reference to FIG. 1 wherein it includes a lower guiding assembly 85 and an upper forcing assembly 86. Assembly 85 includes a shaft 88 slidable in arm 82 and biased upwardly by a spring 89 working against a rounded cap 90. A cutting tool 92 is inserted into a bore in the lower end of shaft 88 and fastened by a set screw.

The cutting tool 92 is forced for a sufficient distance into wafer 10 and with sufficient separation of cut surfaces that a split develops and propagates through the wafer 10 along line 22. Assembly 86 provides the force to advance tool 92 for the required distance and with the required separation of cut surfaces. Significantly, forcing assembly 86 as shown in the illustrative embodiment represents a perceived departure from the prior art especia11y when applied to splitting crystals. Normally, crystals are split by applying a tool to a desired plane and the tool is forced by impact such as from a hammer or a guidably dropped object.

It will be appreciated that the forcing assembly 86 could be arranged to provide a guided impact force. However, it is preferred to provide a gradually applied, calibrated force utilizing the apparatus best seen in FIG. 1.

A spindle 101 is driven by a micrometer head 102 which is locked into arm 83 by a set screw 103. Head 102 has a graduated hub 104 and a sleeve 105 with a tapered, graduated portion 106 and a knurled driving portion 107. Items 101–107 are included in a head assembly sold by Starrett Company of Athol, Mich. The assembly has a 0–1 inch range of travel, 0.025 inch per revolution adjustment with 0.001 inch graduations and is designated as Starrett Model #263RL.

The above described cutter 80 is conveniently amenable to cutting articles having indistinct edge structures. For example, it is known that wafers receiving layers on substrates by liquid epitaxial methods sometimes have edge portions with internally amorphous structures. Such wafers are particularly difficult to cut because the amorphous portion tends to deflect an impact driven tool and cause errant splitting. Also, the tool is sometimes driven too far into the wafer and damages the cut surfaces extensively. It will be appreciated that an important objective is to cut portions from a wafer by causing as little damage as practicable to crystalline planes which eventually serve as windows for laser beams. Cutter 80 is especially advantageous for cutting such wafers in a manner which will now be described with respect to FIG. 4.

Tool 92 includes an elongate portion 93 having a chisel-like termination with a transverse cutting edge 94. Edge 94 is formed by machining a face 95 shown in FIG. 4 and an opposite face 96 (not shown) on a right cylindrical end of portion 93. Such faces 95 and 96 converge longitudinally of portion 93 toward edge 94 with an angle included between them suitable for separating cut surfaces to cause splitting. Such angle relates to various properties of an article 10 such as resiliency of grains or fibers, brittleness, cohesiveness of surfaces along splitting surfaces and similar attributes which bear upon splitting. Normally, one would expect the angle included between faces 95 and 96 to be about sixty degrees for cutting crystals. However, in cutting the described wafer 10, it has been found that an included angle of about ninety degrees provides excellent results with acceptable life of a tool 92. It has also been found that tool 92 is preferably made of a hard carbide such as carbide #883 as made by Carboloy Systems Department of General Electric Company at Detroit, Mich.

It is incidentally seen in FIG. 4 that tool 92 is projected within notch 47 of plate 43 and is advanced at an exposed top edge 27 at side 15 of wafer 10. When wafer 10 is disposed as shown with substrate 12 on top, cutting at edge 27 provides the least risk to damage of heterostructure 14. Also, such cutting should be done at an angle 97 to wafer 10 so that tool 92 advances a sufficient distance into substrate 12 to cause splitting without damage to heterostructure 14. It has been found that angle 97 may vary between about thirty and sixty degrees to cut articles 10 in a preferred manner but that forty-five degrees is preferred for wafer 10.

Angle 97 is normally set between a side surface of tool 92 and the top surface of plate 43 because they relate respectively to the elongate disposition of tool 92 and the top surface 11 of wafer 10. However, it will be evident that angle 98 could as well be utilized to set the cutting angle because edge 94 is cut at about ninety degrees to elongate portion 93. Note that faces 99 and 100 are also ground into tool 92 to enable edge 94 to address wafer 10 without cutting into surface 25 of paper liner 26. Face 99 is needed when tool 92 is turned 180 degrees in its holding shaft 88 (FIG. 1).

FIG. 4 also shows pressure member 76 as it bears on a splitting plane of wafer 10. The stress caused by pressure members 75 and 76, the cutting angle 97 or 98, the included angle between faces 95 and 96, the calibrated gradual force upon tool 92 and the other described aspects and features of the invention cooperate to cut wafer 10 with about 0.010 inch of travel as depicted by phantom lines in FIG. 4.

Operation

In operation of apparatus 30, one places a paper liner 26 in recess 41 of a wafer holder 34. The plate 43 is also placed within recess 41 and upon the surface 25 of paper liner 26, being careful to tightly fit the plate 43 as shown in FIG. 2. Holder positioner 50 is elevated by pivoting the same upwardly and slightly away from wafer press 60. Also, press 60 is elevated by moving toggle arm 66 arcuately vertically as shown in FIG. 3.

A wafer 10 may be placed within recess 41 of a holder 34 before placing holder 34 in position for cutting. To facilitate placement of such wafer in a holder 34, the plate 43 may be marked to locate the sides 17 and 18 with respect to edge 49. The wafer 10 is positioned so its reference side 15 is in intimate contact with side 49 of plate 43.

The wafer holder 34 is slipped under press 60 from the left side of apparatus 30 as shown by phantom lines in FIG. 1. Care is exercised to have holder 34 intimately contact positioning plate 116 and either of plates 115 or 117 depending upon what cut is desired to be made first on wafer 10. For example, it may be desired to cut along the splitting plane represented by line 22 first as shown in FIG. 2 and to make a cut along line 20 later. It will be appreciated that plates 115–117 are made adjustable in position on platform 32 so proper alignment for proper cutting is made.

When an election is made to cut along line 22, the wafer holder 34 is positioned as shown in FIG. 2 and holder positioner 50 is lowered and pressed down to cam holder 34 against plate 116. Press 60 is then lowered to bias pressure members 75 and 76 downwardly upon wafer 10 along line 22. Preferably, the position of wafer 10 relative to apparatus 30 is monitored under a microscope just before and during the cutting process. For example, one should be sure the wafer 10 is supported in a laterally unrestrained manner free of external dirt or debris which may cause peripheral concentrations of stress. Although, reference side 15 is in intimate contact with reference side 49 of plate 43, no restraint is caused thereby because the wafer 10 is forced directly away from side 49 by the expected cutting action.

Conveniently, press 60 provides a resilient force substantially normal to and upon surface 11 of wafer 10. Such force is uniformly applied along line 22 and is sufficient to cause stress along the splitting plane which intersects surface 11 along line 22. The force from press 60 is also sufficient to develop lateral resistance for wafer 10 from an expected cutting force because of friction developed between wafer 10 and paper liner 26.

The cutter 80 is then actuated so tool 92 addresses the exposed top edge 27 of wafer 10 and so elongate portion 93 of the tool forms a preferred angle of about forty-five degrees with surface 11 of wafer 10. Transverse edge 94 of tool 92 is gradually advanced into and along the splitting plane by force applied from assembly 86 to guiding assembly 85. Such force is calibrated by rotating the knurled portion 107 of sleeve 105 and comparing the graduated portion 106 to the graduated hub 104.

Cutting edge 94 advances a sufficient distance into wafer 10 that separation stresses at the splitting plane will facilitate a self-propagating split through wafer 10. Simultaneously, the converging faces 95 and 96 of tool 92 are engaged with the cut surfaces to separate the same according to the included angle of said faces. Consequently, a shelf piece 21 is split from residue portion 23.

To cut another shelf piece 19 from the opposite side of wafer 10, the holder 34 is then moved by first elevating press 60 and holder positioner 50. Then the holder 34 is pushed toward the rear of apparatus 30 until block 36 is in intimate contact with plates 117 and 116. Then the positioner 50 is lowered to cam block 36 against plate 116 and wafer press 60 is lowered to provide pressure along line 20 where the next splitting plane intersects major surface 11 of wafer 10. To cut shelf piece 19 from wafer 10, the above cutting process described for piece 21 is repeated in a corresponding manner.

There have been illustrated herein certain practical embodiments and certain applications of the invention. Nevertheless, it is to be understood that various modifications and refinements may be made and used which differ from these disclosed embodiments without departing from the spirit and scope of the present invention. For example, it is sometimes found advantageous to cover a wafer 10 in a recess 41 with a liquid such as an alcohol to improve the splitting process. It is theorized that the alcohol improves seating of wafer 10 and helps to dissipate injurious shock waves.

It is further advantageous to sometimes limit the travel of cutting tool 92 to avoid digging into the paper liner 26 or cutting the heterostructure 14. Consequently, a feature such as an angle member 120 (FIG. 1) may be utilized to engage the cap 90 and stop the travel of tool 92.

What is claimed is:

1. A method of cutting an article having at least one plane known to facilitate splitting therealong, comprising:

supporting the article in a laterally unrestrained manner on a surface capable of developing lateral restraint by force applied normal to and upon an exposed top surface of the supported article;

applying resilient force substantially normal to and upon the exposed top surface of the article along the splitting plane sufficient to cause separation stresses along such plane and to develop lateral resistance to an expected cutting force; and advancing a cutter at an exposed top edge of the article into and along the splitting plane at a given angle to the exposed top surface, for a sufficient distance and with sufficient separation of cut surfaces, that a split develops and propagates through the article along the splitting plane.

2. A method as in claim 1 wherein the cutter includes an elongate tool with a chisel-like termination having a transverse cutting edge and at least two lateral faces converging longitudinally toward the edge, the advancing step further comprising:

advancing the tool so the elongate portion forms an angle of from about 30 to about 60 degrees with the exposed top surface of the article.

3. A method as in claim 2 wherein the advancing step further comprises:

advancing the cutting edge into the article a sufficient distance to a region along the splitting plane where stresses developed thereat will initiate splitting; and engaging the cut surfaces along the lateral faces of the advancing tool to separate the surfaces by an angle relating to the properties of the article to develop sufficient stresses at the cutting edge to initiate splitting in a self-propagating manner through the article along the splitting plane.

4. A method as in claim 3 wherein supporting the article further comprises:

supporting a substantially planar wafer having a substantially monocrystalline structure.

5. A method as in claim 4 wherein supporting a wafer further comprises:

supporting a wafer having a top monocrystalline structure and at least one monocrystalline layer of different composition in contact with the supporting surface; and cutting a desired portion from the wafer by advancing the tool into an exposed top edge of the top structure at a given angle to the exposed top surface of the wafer for a sufficient distance to split the portion from the wafer without penetrating into the different layer in contact with the supporting surface.

6. A method as in claim 4 wherein the advancing step further comprises:

advancing the cutting tool into the wafer sufficient to initiate the splitting in the self-propagating manner by applying a gradual force to the tool.

7. Apparatus for cutting an article having at least one plane known to facilitate splitting therealong, comprising:

means for supporting the article in a laterally unrestrained manner on a surface capable of developing lateral restraint by force applied normal to and upon an exposed, top surface of the article;

means for applying resilient force substantially normal to and upon the exposed top surface of the article along the splitting plane sufficient to cause separation stresses along such plane and to develop lateral resistance to an expected cutting force; and a cutter disposed at an exposed top edge of the article and means for advancing the cutter into and along the splitting plane at a given angle to the exposed, top surface, for a sufficient distance and with sufficient separation of cut surfaces that a split developes and propagates through the article along the splitting plane.

8. Apparatus as in claim 7 wherein the cutter further comprises:

an elongate tool with a chisel-like termination having a traverse cutting edge and at least two lateral faces converging longitudinally toward the edge; and means for advancing the tool so the elongate portion forms an angle of from about 30 to about 60 degrees with the exposed top surface of the article.

9. Apparatus as in claim 8 wherein the advancing means further comprises:

means for advancing the cutting edge into the article a sufficient distance to a region along the splitting plane where stresses developed thereat will initiate splitting; and the lateral faces of the advancing tool disposed to engage and separate cut surfaces by an angle relating to the properties of the article to develop sufficient stresses at the cutting edge to initiate splitting in a self-propagating manner through the article along the splitting plane.

10. Apparatus as in claim 9 wherein the means for supporting the article further comprises:

means for supporting a substantially planar wafer having a substantially monocrystalline structure.

11. Apparatus as in claim 10 wherein the means for supporting a wafer further comprises:

means for supporting a wafer having at least a top monocrystalline layer and a bottom monocrystalline layer of different composition in contact with the supporting surface; and means for advancing the tool into an exposed top edge of the top layer at a given angle to the exposed top surface of the wafer for a sufficient distance to split a portion from the wafer without penetrating into the bottom layer.

12. Apparatus as in claim 11 wherein the means for advancing further comprises:

means for advancing the cutting tool into the wafer sufficiently to initiate the splitting in the self-propagating manner by applying a gradual force to the tool.

* * * * *